US012352069B2

(12) United States Patent
Barlocker et al.

(10) Patent No.: US 12,352,069 B2
(45) **Date of Patent: *Jul. 8, 2025**

(54) POOL COVER HINGED SLIDING ASSEMBLY

(71) Applicant: Latham Pool Products, Inc., Latham, NY (US)

(72) Inventors: Daniel Barlocker, Eagle Mountain, UT (US); Mathew Dalton, Saratoga Springs, UT (US)

(73) Assignee: Latham Pool Products, Inc., Latham, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/415,911

(22) Filed: Jan. 18, 2024

(65) Prior Publication Data

US 2024/0240478 A1 Jul. 18, 2024

Related U.S. Application Data

(63) Continuation of application No. 17/566,592, filed on Dec. 30, 2021, now Pat. No. 11,913,248.

(60) Provisional application No. 63/133,676, filed on Jan. 4, 2021.

(51) Int. Cl.

| | |
|---|---|
| ***E04H 4/08*** | (2006.01) |
| ***B61B 9/00*** | (2006.01) |
| ***B61B 12/12*** | (2006.01) |

(52) U.S. Cl.

CPC ..... *E04H 4/082* (2013.01); *B61B 9/00* (2013.01); *B61B 12/125* (2013.01); *E04H 4/086* (2013.01)

(58) Field of Classification Search

CPC . B60J 7/062; B60J 7/067–068; B61B 12/125; E04H 4/08–088; E04H 4/10; E04H 4/101; Y10T 24/44043; Y10T 24/44046; Y10T 24/44983

See application file for complete search history.

(56) References Cited

U.S. PATENT DOCUMENTS

| | | | |
|---|---|---|---|
| 5,913,613 | A | 6/1999 | Ragsdale et al. |
| 6,622,318 | B2 | 9/2003 | Mathis |
| 7,047,575 | B2 | 5/2006 | Last |
| 7,780,536 | B2 | 8/2010 | Henry et al. |

(Continued)

FOREIGN PATENT DOCUMENTS

| | | |
|---|---|---|
| CA | 2457572 | 8/2005 |
| CN | 106812401 | 6/2017 |
| KR | 20090005696 | 6/2009 |

OTHER PUBLICATIONS

U.S. Appl. No. 17/566,592, "Non-Final Office Action", Jun. 23, 2023, 10 pages.

(Continued)

*Primary Examiner* — David P Angwin
*Assistant Examiner* — Nicholas A Ros
(74) *Attorney, Agent, or Firm* — Kilpatrick Townsend & Stockton LLP

(57) ABSTRACT

Described is a hinged sliding assembly for a pool cover assembly including a slider member having a rod member and defining an opening, wherein the slider member is coupleable to a pool cover; and a hinged rope lock member coupled to the rod member and positioned at least partially within the opening, wherein the hinged rope lock member is coupleable to a rope of the pool cover.

20 Claims, 9 Drawing Sheets

(56) References Cited

U.S. PATENT DOCUMENTS

| | | | | |
|---|---|---|---|---|
| 8,251,832 | B2 | 8/2012 | Henry et al. | |
| 9,593,499 | B1 * | 3/2017 | Barba, III | E04H 4/086 |
| 9,731,584 | B2 * | 8/2017 | Hannan | B60J 7/068 |
| 11,913,248 | B2 * | 2/2024 | Barlocker | B61B 12/125 |
| 2009/0025134 | A1 | 1/2009 | Stephens | |
| 2009/0126097 | A1 | 5/2009 | Kanetis | |
| 2011/0308003 | A1 | 12/2011 | Scali | |
| 2012/0227213 | A1 * | 9/2012 | Karsten | E04H 4/101 16/87.2 |
| 2014/0208501 | A1 | 7/2014 | Black et al. | |

OTHER PUBLICATIONS

U.S. Appl. No. 17/566,592, "Notice of Allowance", Oct. 19, 2023, 9 pages.
PCT Application No. PCT/US2021/065704, "International Preliminary Report on Patentability", Jul. 13, 2023, 9 pages.
PCT Application No. PCT/US2021/065704, "International Search Report and Written Opinion", Apr. 19, 2022, 13 pages.

* cited by examiner

POOL COVER HINGED SLIDING ASSEMBLY

CROSS REFERENCE TO RELATED APPLICATION

This application is a continuation of U.S. application Ser. No. 17/566,592, filed Dec. 30, 2021, entitled "Pool Cover Hinged Sliding Assembly," which claims the benefit of U.S. Provisional Application No. 63/133,676, filed Jan. 4, 2021, entitled "Pool Cover Hinged Sliding Assembly," the entire contents of each of which are incorporated herein by reference.

FIELD OF THE INVENTION

This application relates generally to pool cover assemblies, and more particularly, although not necessarily exclusively, to pool cover assemblies that include hinged sliding assemblies used to assist in moving a pool cover along a track.

BACKGROUND OF THE INVENTION

Pool cover assemblies, including automated pool cover assemblies, can be installed on various types of pools, including fiberglass pools, gunite or concrete pools, and vinyl liner pools. An automated pool cover assembly may use a motor to cause the pool cover to extend and retract over the pool to cover and uncover the pool. The pool cover assembly may include a track that runs the full length of the pool on both sides along which the pool cover extends and retracts. The pool cover assembly may also include a sliding assembly that attaches to the pool cover and is retained in the track. The sliding assembly may assist in moving the pool cover along the track as the pool cover is extended and retracted. Conventionally, the sliding assembly may permit movement of the pool cover or between components of the sliding assembly itself. This movement may cause excessive wear on the pool cover and/or the sliding assembly.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Certain embodiments and features of the present disclosure relate to pool cover assemblies, including pool cover assemblies that may provide for less wear and potential for damage to the various elements of the pool cover assemblies as the pool cover extends and retracts, which may in some cases negatively affect the functionality of the pool cover system. In some embodiments, the pool cover assembly includes a track, a pool cover that includes a rope extending along at least one edge of the pool cover, and a hinged sliding assembly that includes a slider member and a hinged rope lock member coupled to the slider member.

BRIEF DESCRIPTION OF THE DRAWINGS

A further understanding of the nature and advantages of various embodiments may be realized by reference to the following figures. In the appended figures, similar components or features may have the same reference label.

DETAILED DESCRIPTION

Figure 1:
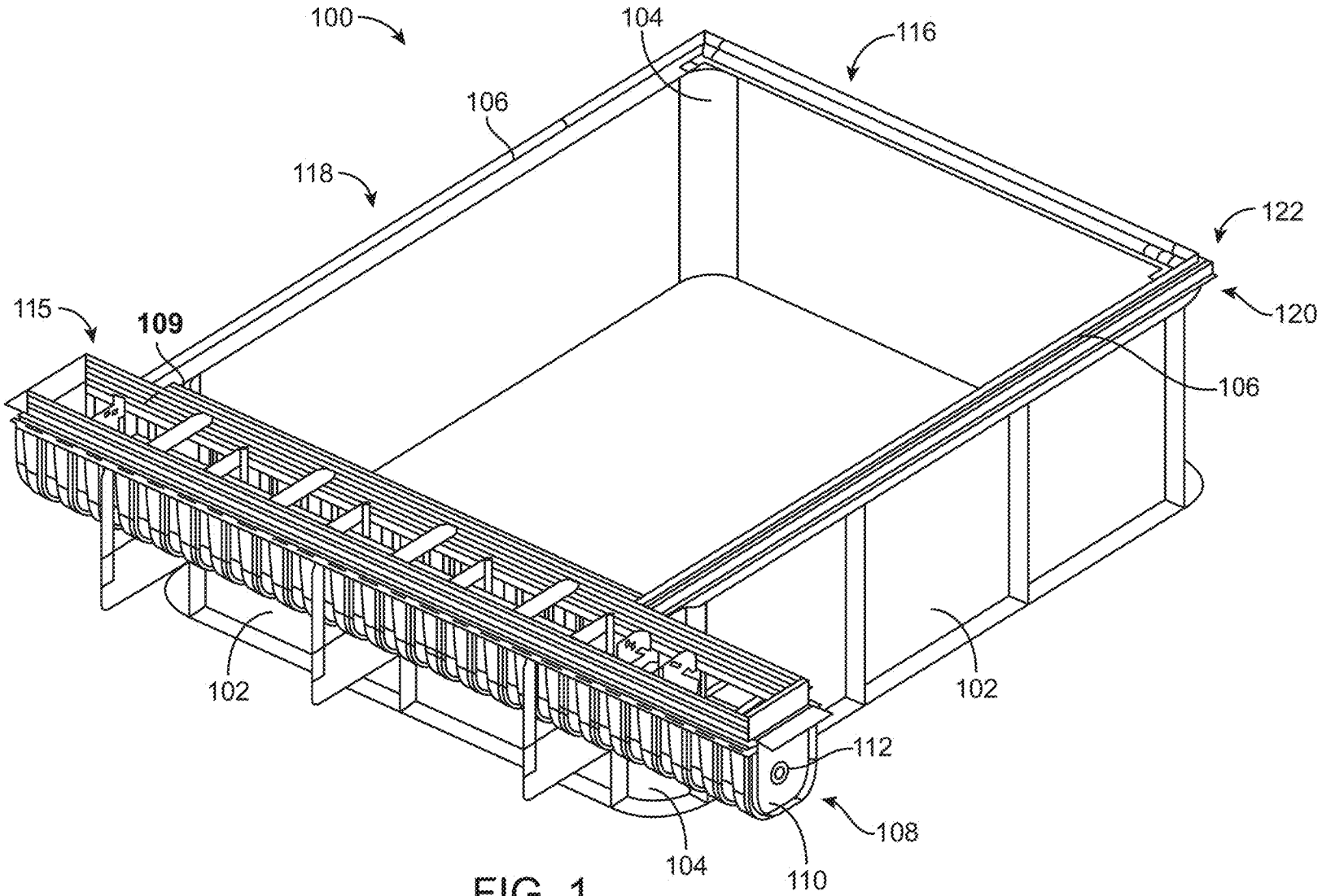
FIG. 1 is a perspective view of a pool and a pool cover assembly according to certain embodiments of the present disclosure.
Figure 2A:
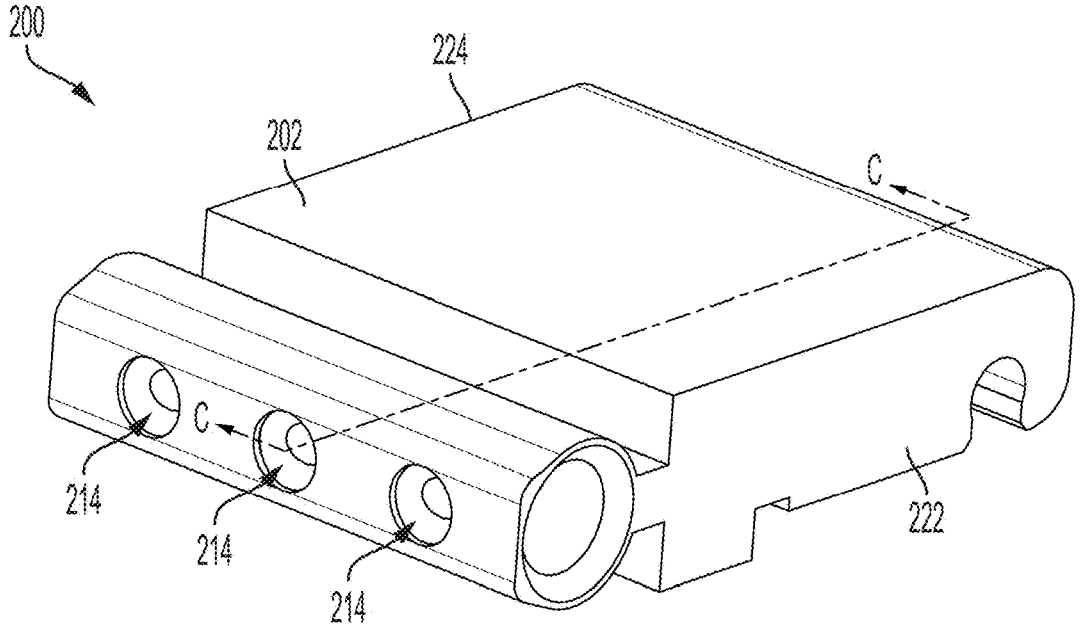
FIG. 2A is an upper perspective view of a hinged rope lock member according to certain embodiments of the present disclosure.
Figure 2B:
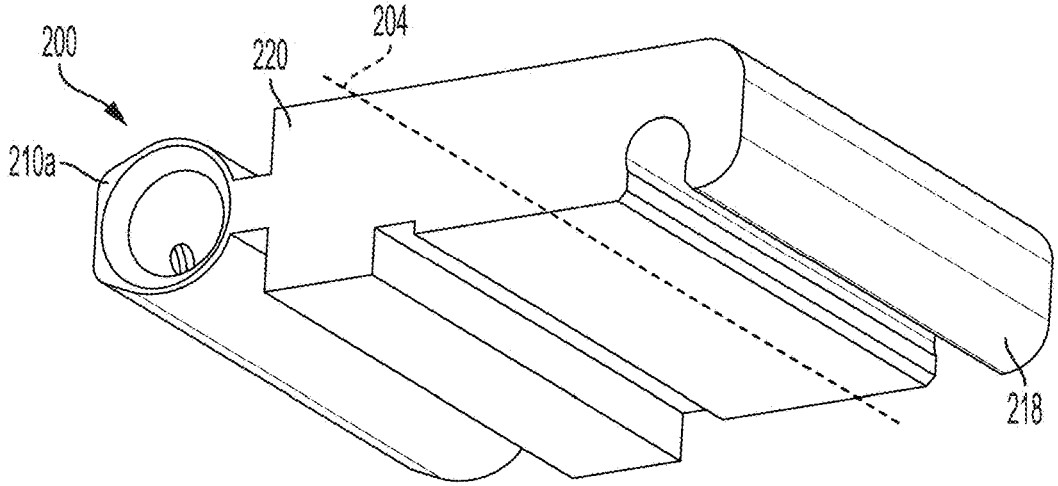
FIG. 2B is a lower perspective view of the hinged rope lock member of FIG. 2A.
Figure 2C:
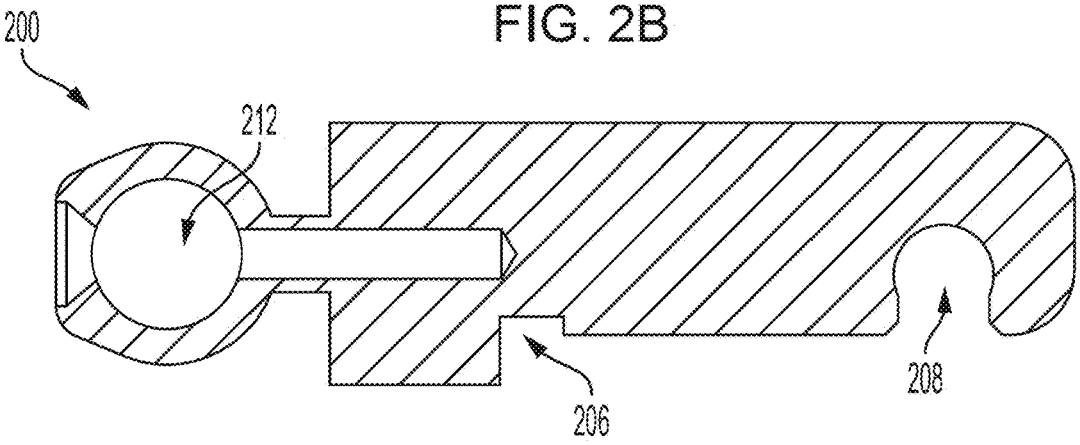
FIG. 2C is a cross-sectional view of the hinged rope lock member of FIG. 2A along line CC.
Figure 3A:
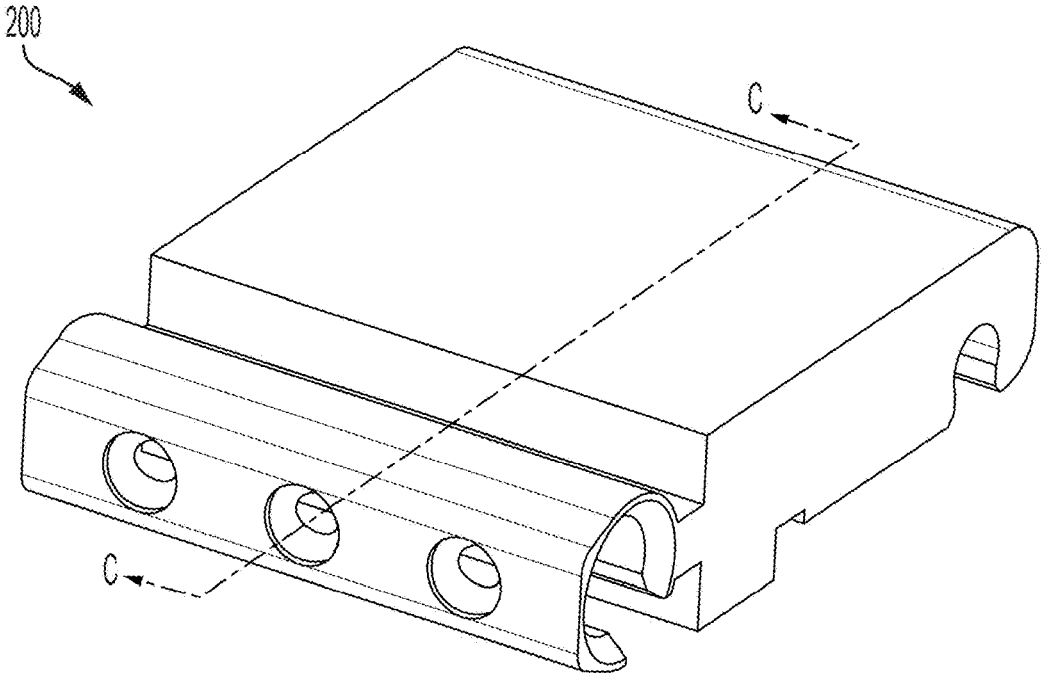
FIG. 3A is an upper perspective view of a hinged rope lock member according to certain embodiments of the present disclosure.
Figure 3B:
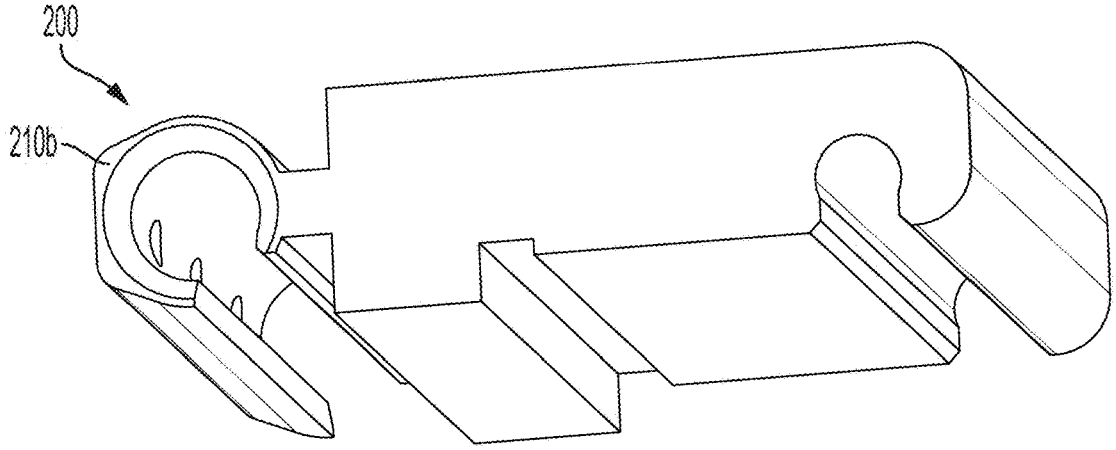
FIG. 3B is a lower perspective view of the hinged rope lock member of FIG. 3A.
Figure 3C:
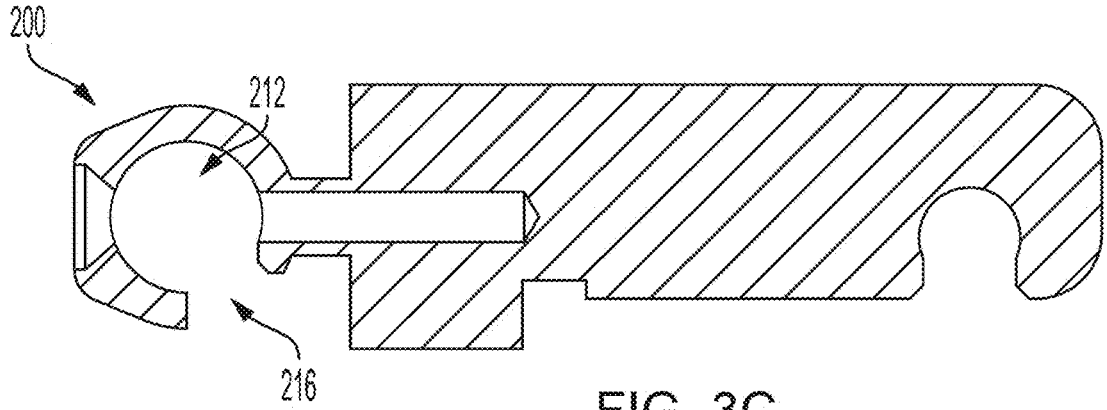
FIG. 3C is a cross-sectional view of the hinged rope lock member of FIG. 3A along line CC.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "upper," "lower," "down," "top," "left," "right," "bottom," among others, are not intended to be limiting and are instead intended to refer to the orientation as illustrated and described in the figure (or figures) to which the components and directions are referencing.

Certain embodiments and features of the present disclosure relate to pool cover assemblies, including pool cover assemblies that may provide for less wear and potential for damage to the various elements of the pool cover assemblies as the pool cover extends and retracts. In some embodiments, the pool cover assembly includes a track, a pool cover that includes a rope extending along at least one edge of the pool cover, and a hinged sliding assembly that includes a slider member and a hinged rope lock member coupled to the slider member.

The hinged rope lock member and the slider member may be coupled to one another by snap-fitting the hinged rope lock member to a rod member that extends across an opening in the slider member. Thus an entire longitudinal length of the hinged rope lock member may be secured relative to the slider member. The hinged rope lock member may slide along and rotate around the rod as necessary, but is constrained to reduce pivoting or twisting in an undesirable manner. The rope may extend through a rope opening of the hinged rope lock member and may be coupled to the hinged rope lock member using any suitable fasteners, e.g., screws. The pool cover may be coupled to the slider member. Due to the coupling of the rope to the hinged sliding assembly and the coupling of the hinged sliding assembly to the pool cover, pulling on the rope causes the pool cover to extend along the track.

As previously mentioned, the coupling of the hinged rope lock member to the slider member reduces undesirable pivoting and twisting of the hinged rope lock member while still allowing for some rotation and movement of the hinged rope lock member around and along the rod member. Undesirable pivoting and twisting of the hinged rope lock member could occur if the hinged rope lock member were not coupled to the slider member due to the forces acting on the hinged rope lock member as the pool cover is being extended and retracted. For example, a free floating hinged rope lock member relative to the slider member may pivot and twist along the horizontal plane extending through the slider member. This can result in unnecessary and excessive wear and damage to the slider member, the hinged rope lock member, and/or the track. Hingedly coupling the hinged rope lock member to the slider member reduces this undesirable pivoting and twisting while still allowing for some movement of the hinged rope lock member. Additionally, by coupling the hinged rope lock member to the slider member using a snap-fit connection, the hinged rope lock member and/or the slider member may be individually replaced or removed for repair if needed.

According to certain embodiments of the present disclosure, as shown in FIG. 1, a pool 100 may include a plurality of wall panels 102, a plurality of corner panels 104, and a pool cover assembly 108. The pool cover assembly 108 may include at least one track 106 that runs substantially along an edge of the pool 100 and may include a pool cover 109. Though the pool 100 is shown having four wall panels 102 and four corner panels 104, more or fewer wall panels 102 and corner panels 104 may define the pool 100, in some aspects the pool 100 may be a vinyl liner pool, a fiberglass pool, a concrete pool, or a gunite pool and may be formed in-ground or above-ground.

The various elements of the pool 100 described below may be formed of materials including but not limited to aluminum, steel, stainless steel, concrete, stone, plastic, ceramic, fiberglass, aramid fibers, polymer, polycarbonate, polypropylene, other metallic materials, composite materials, or other similar materials. Additionally, each element of the pool 100 may be formed of the same materials or of different materials.

The plurality of wall panels 102 may be joined together along with the plurality of corner panels 104 to form the outer structure and sides of the pool 100. The pool 100 is formed up at an upper edge of the plurality of wall panels 102 and the plurality of corner panels 104 to allow for concrete or a deck to be formed around the pool 100. A plurality of encapsulation members may be coupled to the upper edge of the plurality of wall panels 102 and the plurality of corner panels 104 to form up the pool 100.

In some embodiments, the pool cover assembly 108 may be automated and is at least partially housed in a housing 110 at a first end 115 of the pool 100. The housing may also include a roller tube 112, which the pool cover 109 is rolled up on and rolled off of inside the housing 110. The pool cover 109 may be in a stored position when the pool cover 109 is rolled up on the roller tube 112 and may be in a deployed position when the pool cover 109 has been at least partially rolled off the roller tube 112 at least to partially cover the pool 100.

In some embodiments, the track 106 extends around two or more edges of the pool 100. For example, in some embodiments, the track 106 may extend around three sides of the pool 100 excluding the first end 115. In some embodiments, only a third edge 118 and a fourth edge 120 each include a track 106 that extends the full length of the pool 100. Thus, the pool cover 109 may travel within the track 106 as the pool cover 109 is extended and retracted. In some embodiments, the pool cover 109 may include a rope, a bead, or other suitable feature extending along the length of the pool cover 109 that may engage with the track 106 to retain the pool cover 109 within the track 106 and above the water of the pool 100. The rope may have any suitable cross-section, e.g., circular, square, triangular, rectangular, hexagonal, etc., and may be formed from any suitable material where the length of the material is substantially larger than the diameter, e.g., fibers twisted together, a single extruded material, metal material, etc.

When the pool cover assembly 108 is automated, a motor (not shown) may be used to extend the pool cover 109 along the at least one track 106 across the pool 100. For example, the at least one track 106 may receive at least a portion of the pool cover 109, and the motor may cause the pool cover 109 to move from the first end 115 of the pool 100 proximate to the housing 110 to extend in a direction towards a second end 116 of the pool 100 and may cause the pool cover to at least partially roll off the roller tube 112. The second end 116 of the pool 100 is positioned at an opposite end of the pool 100 from the first end 115. When the pool cover 109 extends to the second end 116, the pool 100 is covered or enclosed by the pool cover 109. However, for clarity purposes, this is not shown in FIG. 1. The motor may also be used to retract the pool cover 109 when the pool cover is in a deployed position by causing the pool cover 109 to move from the second end 116 to the first end 115 and at least partially roll up on the roller tube 112. In other embodiments, the pool cover 109 may be moved manually from the first end 115 of the pool 100 towards the second end 116 of the pool 100.

In some embodiments, the roller tube 112 may act as a winch and rolls the rope onto the roller tube 112. The rope may extend through a set of pulleys positioned at the second end 116. Thus the rope may be moved by the motor through the set of pulleys to cause the pool cover 109 at least to partially roll on or off of the roller tube 112. The rope may be a Dyneema® or an ultra-high-molecular-weight polyethylene (UHMWPE) rope or any other suitable type of rope or other suitable material.

Figure 4A:
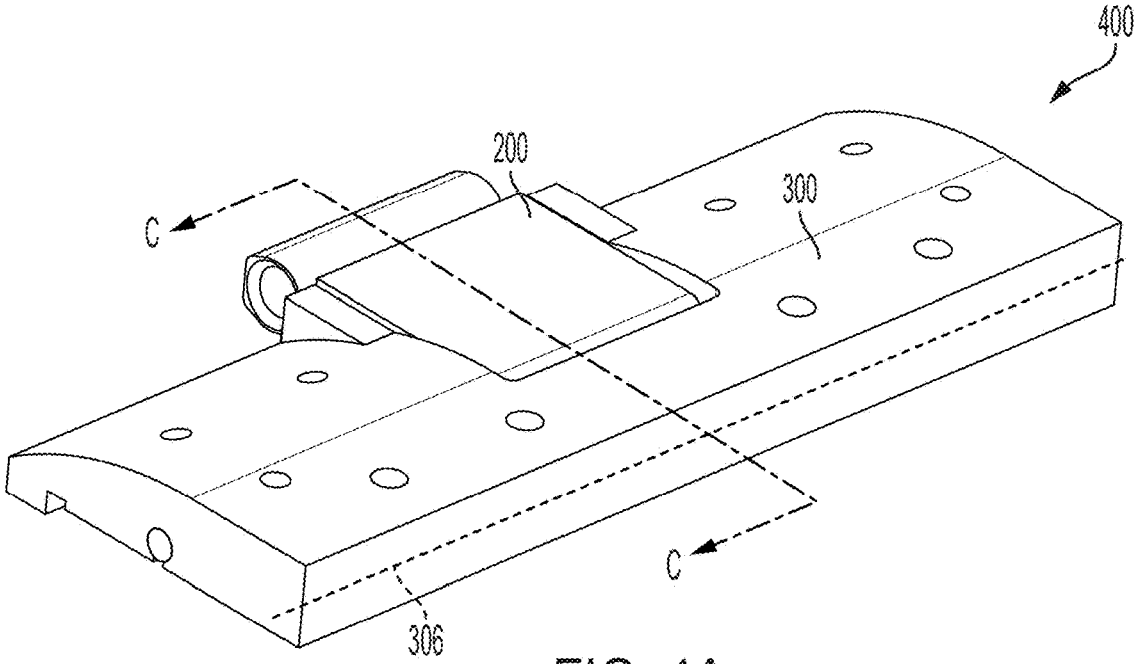
FIG. 4A is an upper perspective view of a hinged sliding assembly with a hinged rope lock member coupled to a slider member according to certain embodiments of the present disclosure.
Figure 4B:
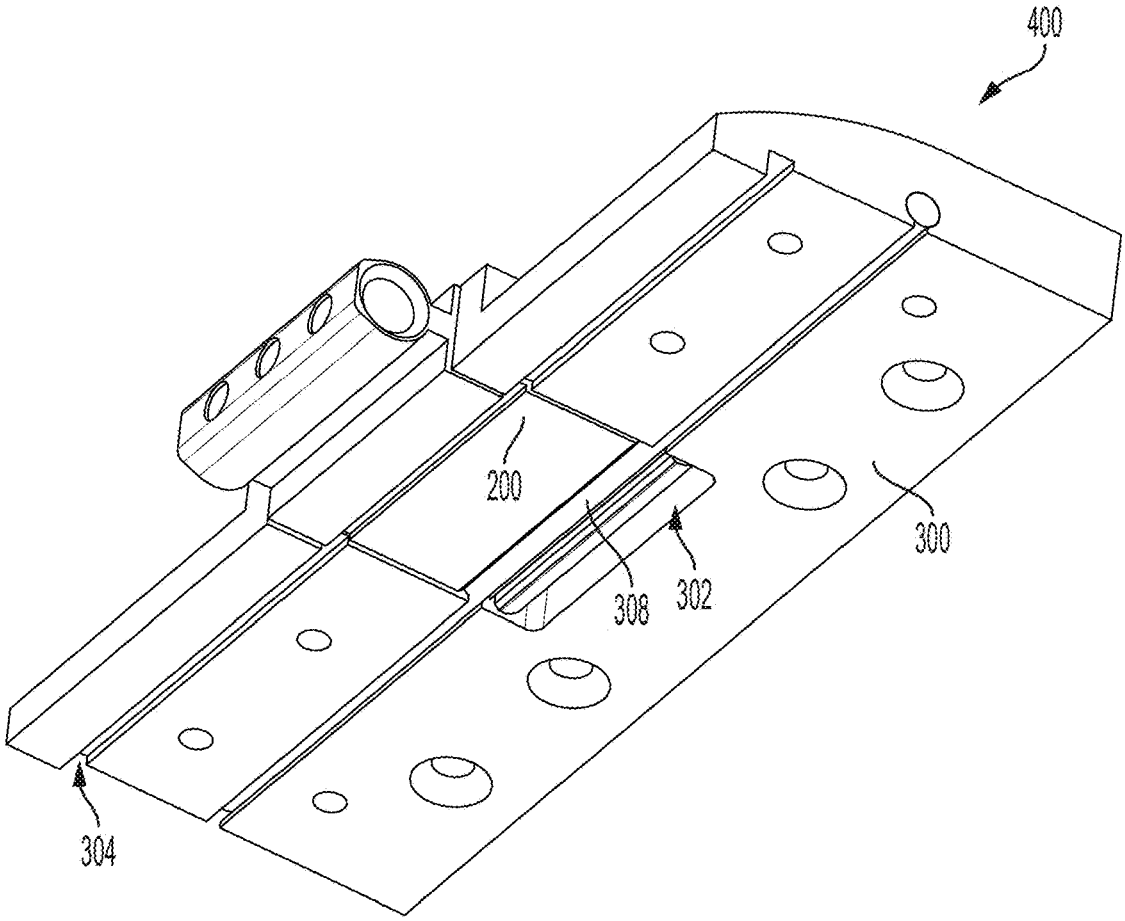
FIG. 4B is a lower perspective view of the hinged sliding assembly of FIG. 4A.
Figure 4C:
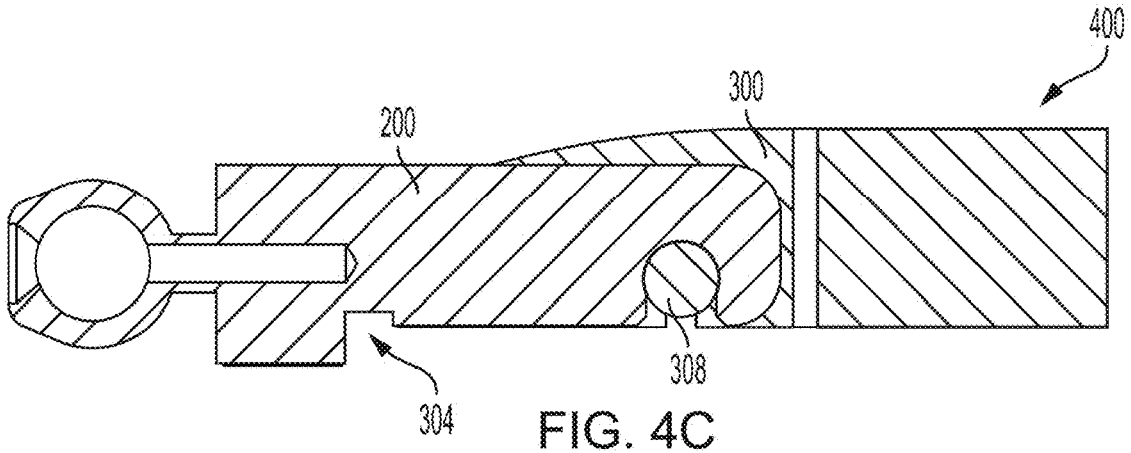
FIG. 4C is a cross-sectional view of the hinged sliding assembly of FIG. 4A along line CC.
Figure 4D:
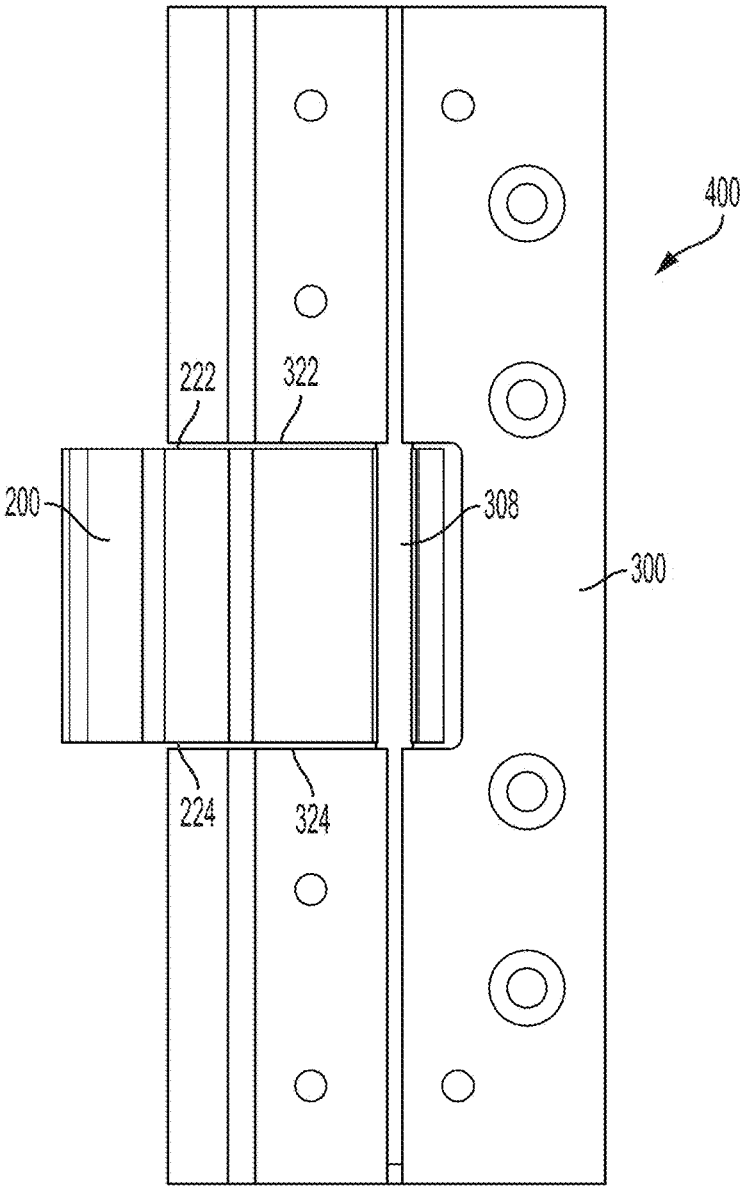
FIG. 4D is a bottom view of the hinged sliding assembly of FIG. 4A.
Figure 5A:
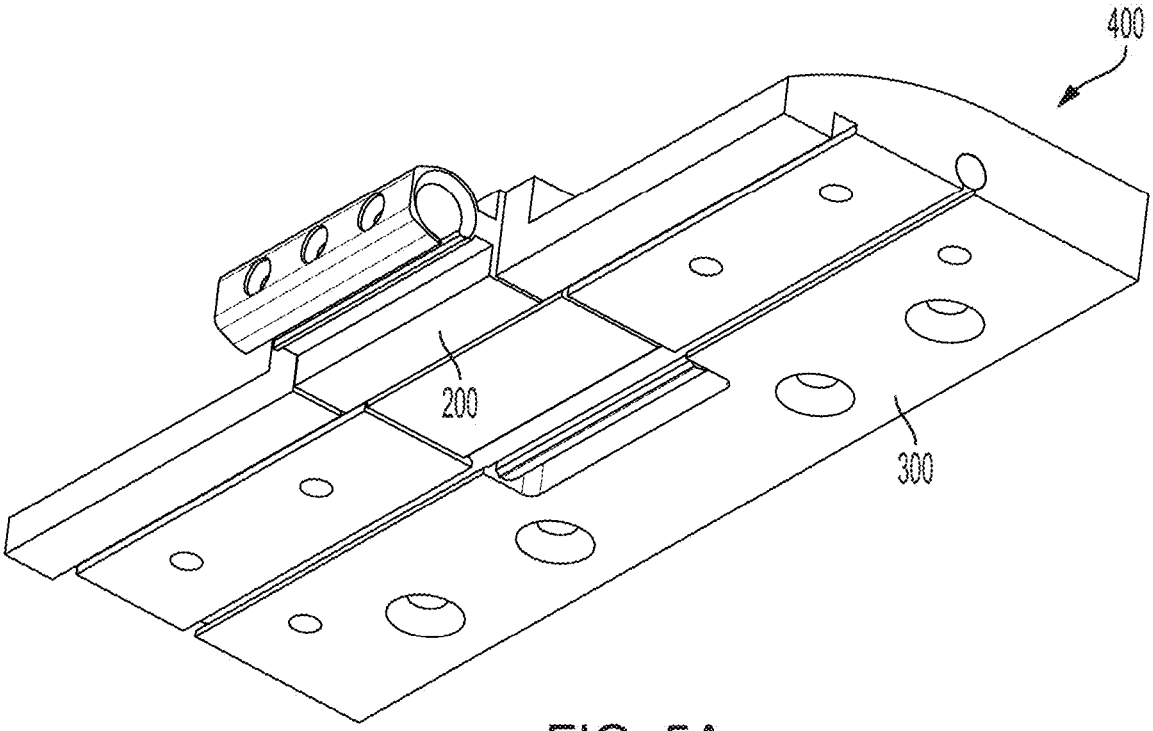
FIG. 5A is a lower perspective view of a hinged sliding assembly with a hinged rope lock member coupled to a slider member according to certain embodiments of the present disclosure.
Figure 5B:
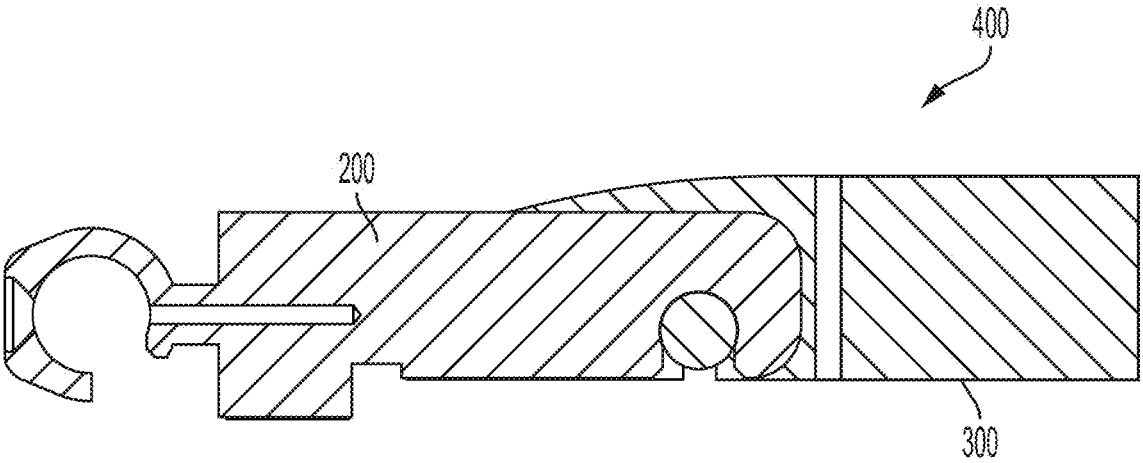
FIG. 5B is a cross-sectional view of the hinged sliding assembly of FIG. 5A.

In some embodiments, the pool cover assembly 108 also includes a hinged sliding assembly 400 (as shown in FIGS. 4A-5B) that may include a hinged rope lock member 200 as shown in FIGS. 2A-3C and a slider member 300 (shown in FIGS. 4A-4B). The hinged rope lock member 200 may have a body 202 having a longitudinal length 204. The body 202 may define a groove 206 and an attachment opening 208 each extending at least partially along the longitudinal length 204 of the body 202. The body 202 may have any suitable shape, e.g., rectangular, circular, triangular, trapezoidal, polygonal, etc.

Additionally, the hinged rope lock member 200 may include a sleeve 210*a* integrally formed with or coupled to the body 202. The sleeve 210 may define a rope opening 212 extending along the longitudinal length 204 of the body 202 and at least one fastener opening 214, which may extend substantially perpendicular to the longitudinal length 204 of the body 202. In some embodiments, as may be seen in FIGS. 2A-2C, the sleeve 210*a* may completely encircle the rope opening 212 except for the at least one fastener opening 214. In further embodiments, as may be seen in FIGS. 3A-3C, the hinged rope lock member 200 may instead include a sleeve 210*b* that may not be fully closed so as to define a snap-fit opening 216 that provides access to the rope opening 212. The remaining features of the hinged rope lock member 200 may be the same as those shown in FIGS. 2A-2C.

The attachment opening 208 may be positioned proximate to a first end region 218 of the body 202 and the sleeve 210*a* may be positioned proximate to, extend from, or be coupled to a second end region 220 of the body 202. It is understood that the first end region 218 and the second end region 220 are not meant to be limiting and may be switched so that the attachment opening 208 may be positioned proximate to the second end region 220 and the sleeve 210*a* may be positioned proximate to, extend from, or be coupled to the first end region 218. Further, the body 202 may have a leading edge 222 and a trailing edge 224.

The hinged rope lock member 200 may be coupled to the slider member 300 to form the hinged sliding assembly 400, as shown in FIGS. 4A-5B. As shown in FIGS. 4A-5B, the slider member 300 defines an opening 302 that may be sized and shaped to receive the hinged rope lock member 200. The slider member 300 has a longitudinal length 306. The groove 304 may extend at least partially along the longitudinal length of the slider member 300. The slider member 300 may have any suitable shape, e.g., rectangular, circular, triangular, trapezoidal, polygonal, etc. In some embodiments, the slider member 300 may define a plurality of openings extending through the slider member 300. The plurality of openings may assist with or permit the coupling of the pool cover 109 to the slider member 300.

The slider member 300 may include a rod member 308 that may extend at least partially along the longitudinal length 306 of the slider member 300. In some embodiments, the rod member 308 extends along the entire longitudinal length 306 of the slider member 300. The rod member 308 extends through the slider member 300 such that at least a portion of the rod member 308 extends across the opening 302.

In certain embodiments, the opening 302 is sized and shaped to receive at least a portion of the hinged rope lock member 200. The hinged rope lock member 200 may be positioned within the opening 302 and may be hingedly coupleable to the slider member 300. For example, the hinged rope lock member 200 may be snap-fit to the rod member 308 via the attachment opening 208. Additionally, the hinged rope lock member 200 may be coupled to the rod member 308 of the slider member 300 along the entire longitudinal length 204 of the hinged rope lock member 200.

The snap-fit engagement between the hinged rope lock member 200 an the rod member 308 permits lateral movement of the hinged rope lock member 200 along the rod member 308 as well as rotational movement of the hinged rope lock member 200 about the rod member 308. As the hinged rope lock member 200 slides along the rod member 308, the leading edge 222 of the hinged rope lock member 200 may contact or abut a leading edge 322 of the opening 302 of the slider member 300. Furthermore, as the hinged rope lock member 200 slides along the rod member 308, the trailing edge 224 of the hinged rope lock member 200 may contact or abut a trailing edge 324 of the opening 302 of the slider member 300.

The coupling of the hinged rope lock member 200 to the slider member 300 reduces undesirable pivoting and twisting of the hinged rope lock member while still allowing for some rotation and movement of the hinged rope lock member 200 around and along the rod member 308. Undesirable pivoting and twisting of the hinged rope lock member 200 may occur if the hinged rope lock member 200 is not coupled to the slider member 300 due to the forces acting on the hinged rope lock member 200 as the pool cover is being extended and retracted. For example, a free floating hinged rope lock member relative to the slider member 300 may pivot and twist along the horizontal plane extending through the slider member 300. This can result in unnecessary and excessive wear and damage to the slider member 300, the hinged rope lock member 200, and/or the track.

FIG. 6A-6D depicts the hinged sliding assembly 400 with the hinged rope lock member 200 coupled to the slider member 300, the pool cover 109, and the track 106 of the pool cover assembly 108. The hinged sliding assembly 400 may be coupled to the pool cover 109, which may include the rope 604, and may be at least partially arranged within the track 106 of the pool cover assembly 108, as shown in FIGS. 6A-7B. The pool cover 109, rope 604, and track 106 may be the same or include the same or similar elements as the pool cover 109, the rope 604, and the track 106, respectively, discussed in relation to FIG. 1.

Figure 6A:
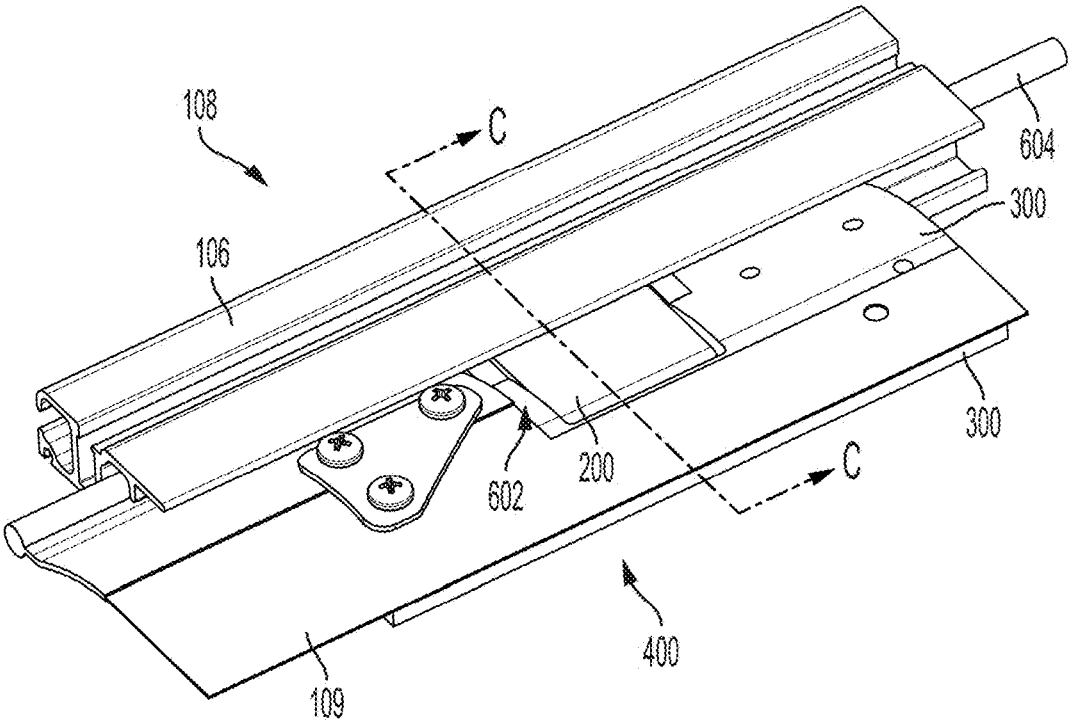
FIG. 6A is an upper perspective view of a hinged sliding assembly coupled with a pool cover and partially retained within a track according to certain embodiments of the present disclosure.
Figure 6B:
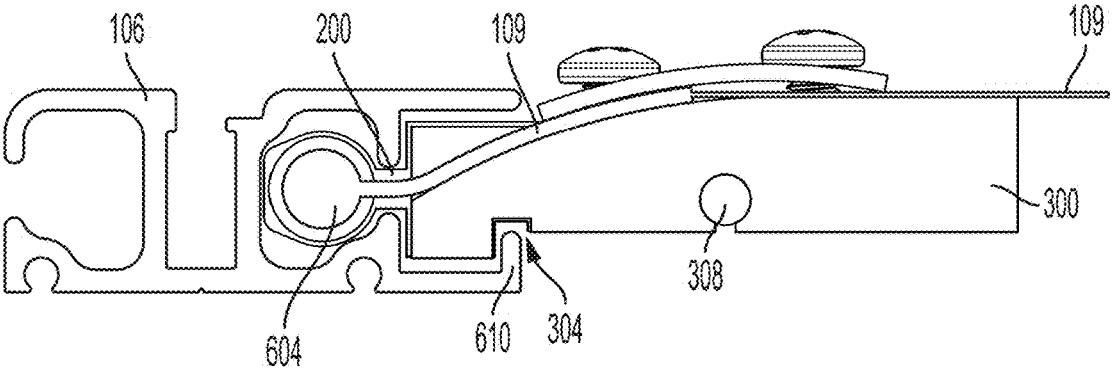
FIG. 6B is a front view of the hinged sliding assembly coupled with the pool cover and partially retained within the track of FIG. 6A.
Figure 6C:
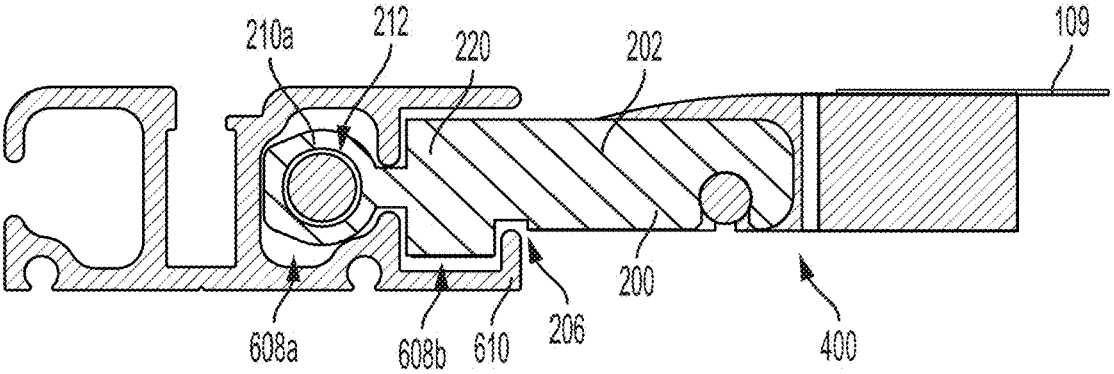
FIG. 6C is a cross-sectional view along line CC of the hinged sliding assembly coupled with the pool cover and partially retained within the track of FIG. 6A.

FIG. 6B shows a front view of the hinged sliding assembly 400 coupled with the pool cover 109 and partially retained within the track 106 of FIG. 6A, and FIG. 6C shows a cross-sectional view along line CC of the hinged sliding assembly 400 coupled with the pool cover 109 and partially retained within the track 106 of FIG. 6A.

In some embodiments, the pool cover 109 may be coupled to the hinged sliding assembly 400 via the slider member 300. For example, one or more screws or any other suitable fastener (e.g., screws, nuts and bolts, snap-fit buttons, adhesive, etc.) may extend through the pool cover 109 and the plurality of openings in the slider member 300 to couple the pool cover 109 to the slider member 300. However, any other suitable form of attachment may be used to couple the pool cover 109 to the slider member 300. Additionally, the pool cover 109 may be coupled to the hinged sliding assembly 400 via the hinged rope lock member 200 by having the rope 604 positioned within the rope opening 212 of the sleeve 210*a* (or sleeve 210*b* as shown and discussed below in relation to FIGS. 7A-7B). The rope 604 may be further secured to the sleeve 210*a* (or sleeve 210*b*), for example via one or more fasteners (e.g., screws, nuts and bolts, snap-fit buttons, adhesive, etc.) which in some embodiments may pass through the at least one fastener opening 214 in the sleeve 210*a* (or 210*b*).

In some embodiments, the pool cover 109 may define an opening 602. The opening 602 may substantially align with the hinged rope lock member 200 when the pool cover 109 is coupled to the hinged sliding assembly 400 so that the pool cover 109 does not cover the hinged rope lock member 200. Thus, the pool cover 109 does not obstruct any movement of the hinged rope lock member 200 relative to the slider member 300. Additionally, the opening 602 may extend along a length of the pool cover 109 so that the hinged rope lock member 200 and at least a portion of the slider member 300 is not covered by the pool cover 109.

For example, at a front end of the hinged sliding assembly 400, the pool cover 109 may extend substantially continuously from the rope 604 across the slider member 300 as is shown in FIG. 6B. After the opening 602, the pool cover 109 may extend only partially across the slider member 300 as is shown in FIG. 6C.

As shown in FIGS. 6A-6C the pool cover assembly 108 may be assembled such that the hinged sliding assembly 400 is positioned such that at least a portion of the hinged rope lock member 200 and at least a portion of the slider member 300 are positioned within at least one channel 608*a*, 608*b* of the track 106. For example, the sleeve 210*a* of the hinged rope lock member 200 and the rope 604 may be positioned within the channel 608*a*, and at least a portion of the body 202, e.g., the second end region 220 of the body 202, may be positioned within the channel 608*b*. In some embodiments, the groove 206 of the hinged rope lock member 200 and the groove 304 of the slider member 300 may engage with a lip 610 of the track 106 when the portions of the hinged rope lock member 200 and the slider member 300 are positioned within the at least one channel 608 of the track 106.

Figure 6D:
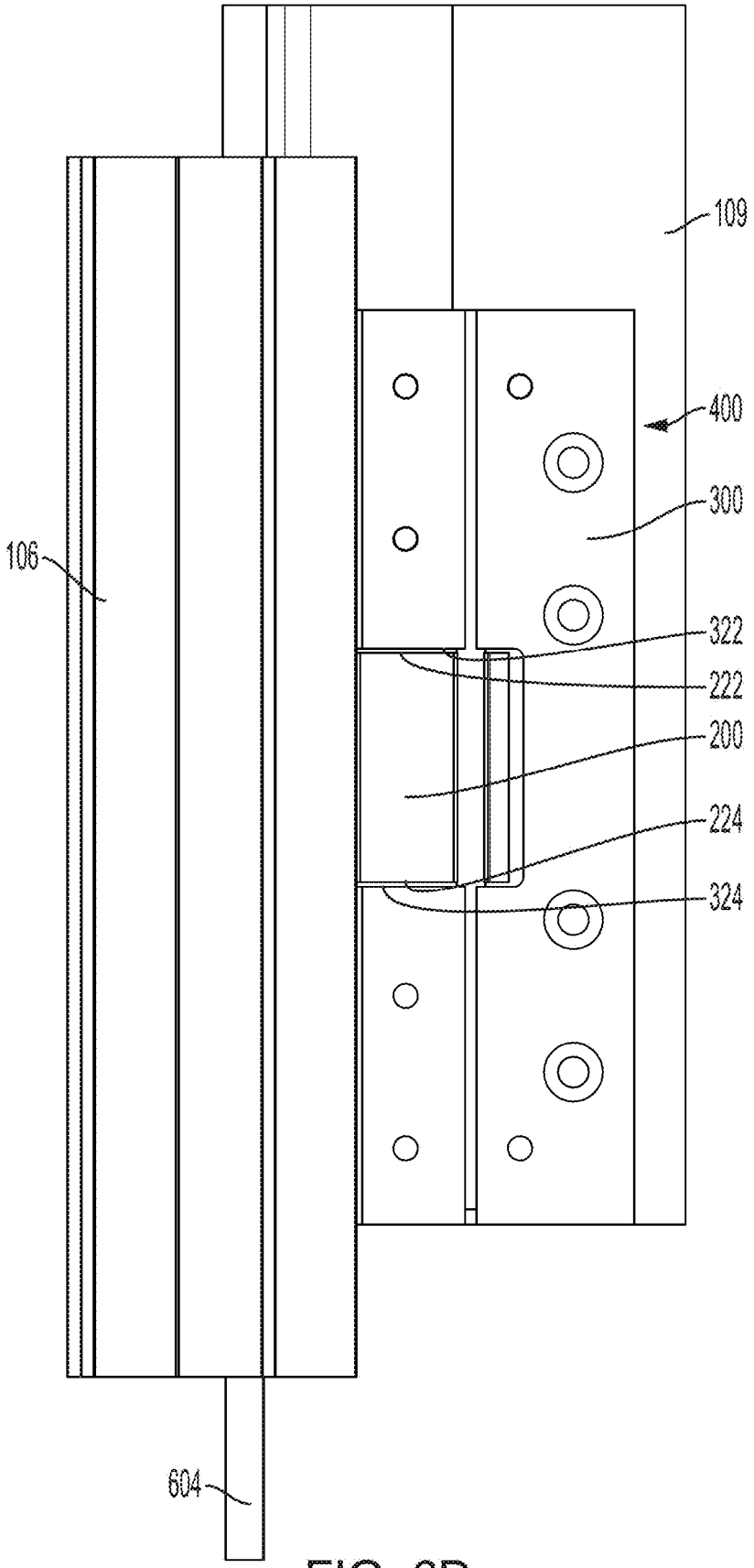
FIG. 6D is a bottom view of the hinged sliding assembly coupled with the pool cover and partially retained within the track of FIG. 6A.

FIG. 6D shows a bottom view of the hinged sliding assembly 400 coupled with the pool cover 109 and partially retained within the track 106 of FIG. 6A.

Figure 7A:
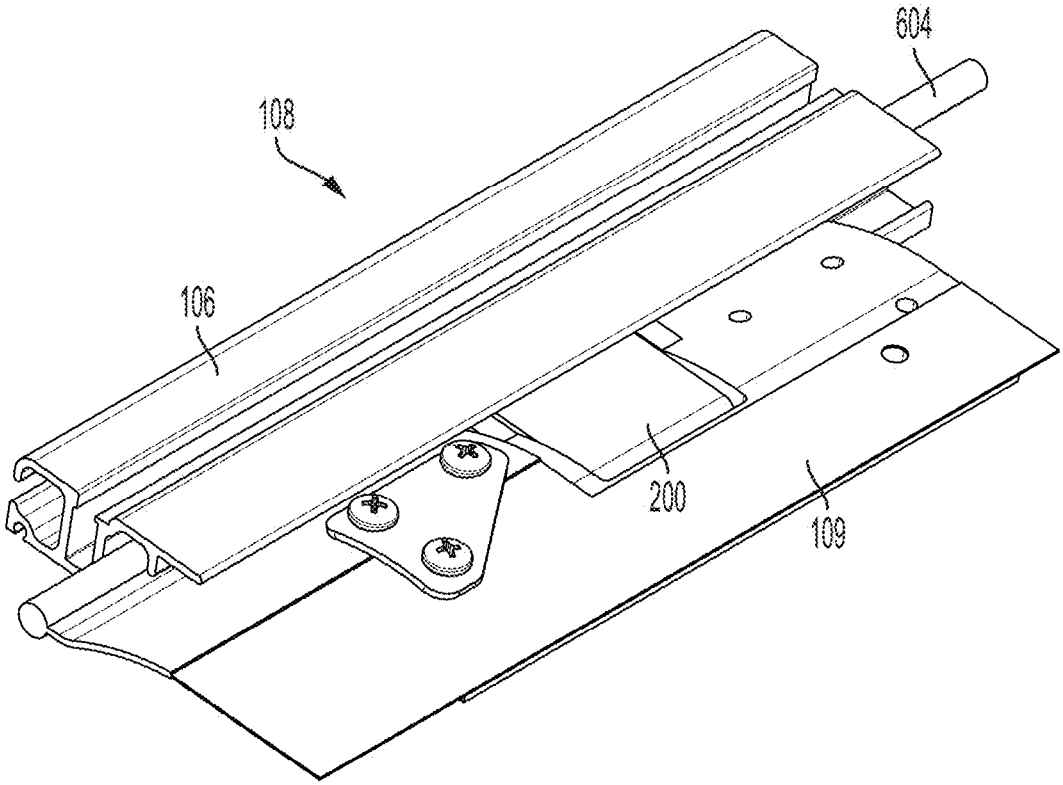
FIG. 7A is an upper perspective view of a hinged sliding assembly coupled with a pool cover and partially retained within a track according to certain embodiments of the present disclosure.
Figure 7B:
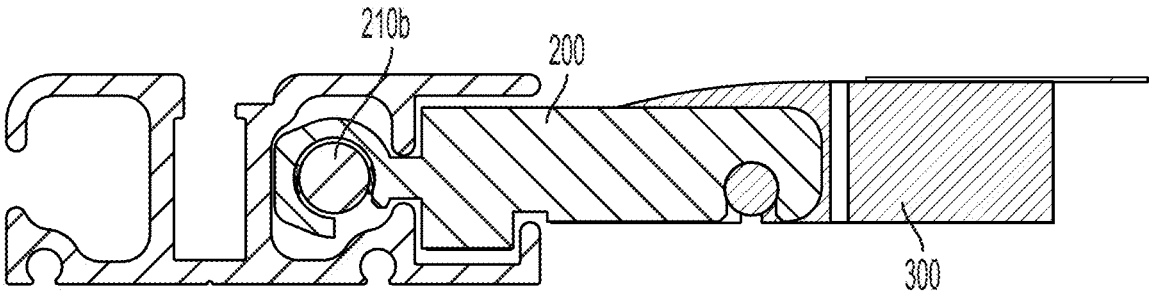
FIG. 7B is a cross-sectional view of the hinged sliding assembly coupled with the pool cover and partially retained within the track of FIG. 7A.

FIGS. 7A-7B show the pool cover assembly 108 where the hinged rope lock member 200 of the hinged sliding assembly 400 includes the sleeve 210*b* that may not be fully closed.

In some embodiments, the longitudinal length 204 of the hinged rope lock member 200 and the longitudinal length 306 of the slider member 300 may be substantially parallel to the track 106 when the hinged sliding assembly 400 is arranged within the at least one channel 608 of the track 106. When a tension force is applied to the rope 604 on either side of the hinged rope lock member 200, the tension force will cause the hinged sliding assembly 400 to move along the at least one channel 608 of the track 106.

For example, as the hinged rope lock member 200 slides along the rod member 308 due to the tension force applied to a leading side of the rope 604, the leading edge 222 of the hinged rope lock member 200 may contact or abut a leading edge 322 of the opening 302 of the slider member 300. This contact will cause the slider member 300 and the attached pool cover 109 to move along with the hinged rope lock member 200 and thus extend the pool cover 109 over the pool. Furthermore, as the hinged rope lock member 200 slides along the rod member 308 due to the tension force applied to a trailing side of the rope 604, which is an opposite direction to the tension force applied to the leading side of the rope 604, the trailing edge 224 of the hinged rope lock member 200 may contact or abut a trailing edge 324 of the opening 302 of the slider member 300. This contact will cause the slider member 300 and the attached pool cover 109 to move along with the hinged rope lock member 200 and thus retract the pool cover 109 over the pool.

Different arrangements of the components depicted in the drawings or described above, as well as components and steps not shown or described are possible. Similarly, some features and sub-combinations are useful and may be employed without reference to other features and sub-combinations. Examples of the invention have been described for illustrative and not restrictive purposes, and alternative examples will become apparent to readers of this patent. Accordingly, the present invention is not limited to the examples described above or depicted in the drawings, and various examples and modifications may be made without departing from the scope of the claims.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

As used below, any reference to a series of examples is to be understood as a reference to each of those examples disjunctively (e.g., "Examples 1-4" is to be understood as "Examples 1, 2, 3, or 4"). In the following, further examples are described to facilitate the understanding of the invention:

Example 1 is a hinged sliding assembly (which may incorporate features of any of the subsequent examples) for a pool cover assembly comprising: a slider member comprising a rod member and defining an opening, wherein the slider member is coupleable to a pool cover; and a hinged rope lock member coupled to the rod member and positioned at least partially within the opening, wherein the hinged rope lock member is coupleable to a rope of the pool cover.

Example 2 is the hinged sliding assembly of example(s) 1 or any of the preceding or subsequent examples, wherein the rod member extends at least partially across the opening.

Example 3 is the hinged sliding assembly of example(s) 1 or any of the preceding or subsequent examples, wherein the rod member extends substantially along a longitudinal length of the slider member.

Example 4 is the hinged sliding assembly of example(s) 1 or any of the preceding or subsequent examples, wherein the hinged rope lock member is coupled to the rod member along an entire longitudinal length of the hinged rope lock member.

Example 5 is the hinged sliding assembly of example(s) 1 or any of the preceding or subsequent examples, wherein the hinged rope lock member is slidable along and rotatable about the rod member.

Example 6 is the hinged sliding assembly of example(s) 1 or any of the preceding or subsequent examples, wherein a leading edge and a trailing edge of the hinged rope lock member contact a leading edge and a trailing edge of the opening as the hinged rope lock member slides along the rod member.

Example 7 is the hinged sliding assembly of example(s) 1 or any of the preceding or subsequent examples, wherein the hinged rope lock member is coupled to the rod member via a snap-fit engagement.

Example 8 is a pool cover assembly (which may incorporate features of any of the preceding or subsequent examples) comprising: a track; a pool cover comprising a rope extending along at least one edge of the pool cover; and a hinged sliding assembly moveable along the track, the hinged sliding assembly comprising: a slider member comprising a rod member and defining an opening, wherein the slider member is coupled to the pool cover; and a hinged rope lock member coupled to the rod member proximate a first end of the hinged rope lock member, coupled to the rope proximate a second end of the hinged rope lock member, and positioned at least partially within the opening.

Example 9 is the pool cover assembly of example(s) 8 or any of the preceding or subsequent examples, wherein the slider member and the hinged rope lock member are arranged at least partially within a channel of the track.

Example 10 is the pool cover assembly of example(s) 8 or any of the preceding or subsequent examples, wherein the rod member extends at least partially across the opening.

Example 11 is the pool cover assembly of example(s) 8 or any of the preceding or subsequent examples, wherein the rod member extends substantially along a longitudinal length of the slider member.

Example 12 is the pool cover assembly of example(s) 8 or any of the preceding or subsequent examples, wherein the hinged rope lock member is coupled to the rod member along an entire longitudinal length of the hinged rope lock member.

Example 13 is the pool cover assembly of example(s) 8 or any of the preceding or subsequent examples, wherein the hinged rope lock member is slidable along and rotatable about the rod member.

Example 14 is the pool cover assembly of example(s) 8 or any of the preceding or subsequent examples, wherein a leading edge and a trailing edge of the hinged rope lock member contacts a leading edge and a trailing edge of the opening as the hinged rope lock member slides along the rod member.

Example 15 is the pool cover assembly of example(s) 8 or any of the preceding or subsequent examples, wherein the hinged rope lock member is coupled to the rod member via a snap-fit engagement.

16. A method (which may incorporate features of any of the preceding or subsequent examples) of extending or retracting a pool cover, the method comprising: applying a force to a rope, wherein the rope extends along at least one edge of the pool cover and is coupled to a hinged rope lock member of a pool cover assembly, wherein the pool cover assembly comprises: a track; the pool cover comprising the rope extending along at least one edge of the pool cover; and a hinged sliding assembly moveable along the track, the hinged sliding assembly comprising: a slider member comprising a rod member and defining an opening, wherein the slider member is coupled to the pool cover; and the hinged rope lock member coupled to the rod member proximate a first end of the hinged rope lock member, coupled to the rope proximate a second end of the hinged rope lock member, and positioned at least partially within the opening; first sliding, in response to the applying a force step, the hinged rope lock member along the rod member in a first direction; and second sliding, in response to the first sliding step, the slider member along the track to extend the pool cover.

Example 17 is the method of example(s) 16 or any of the preceding or subsequent examples, further comprising: applying an opposite force to the rope; third sliding, in response to the applying the opposite force step, the hinged rope lock member along the rod member in a second direction; and fourth sliding, in response to the third sliding step, the slider member along the track to retract the pool cover.

Example 18 is the method of example(s) 17 or any of the preceding or subsequent examples, wherein a leading edge of the hinged rope lock member contacts a leading edge of the opening during the second sliding, and a trailing edge of the hinged rope lock member contacts a trailing edge of the opening during the fourth sliding.

Example 19 is the method of example(s) 16 or any of the preceding or subsequent examples, wherein the hinged rope lock member is coupled to the rod member along an entire longitudinal length of the hinged rope lock member.

Example 20 is the method of example(s) 16 or any of the preceding or subsequent examples, wherein the hinged rope lock member is slidable along and rotatable about the rod member.

That which is claimed is:

1. A hinged sliding assembly for a pool cover assembly comprising:

a slider member comprising a rod member and defining an opening, wherein the slider member is coupleable to a pool cover and the rod member extends at least partially across the opening; and a hinged rope lock member at least partially surrounding the rod member and positioned at least partially within the opening, wherein the hinged rope lock member is coupleable to a rope of the pool cover.

2. The hinged sliding assembly of claim 1, wherein the rod member extends across an entirety of the opening.

3. The hinged sliding assembly of claim 1, wherein the rod member extends parallel to a longitudinal length of the slider member.

4. The hinged sliding assembly of claim 1, wherein the hinged rope lock member at least partially surrounds the rod member along an entire longitudinal length of the hinged rope lock member.

5. The hinged sliding assembly of claim 1, wherein the hinged rope lock member is rotatable about the rod member.

6. The hinged sliding assembly of claim 1, wherein the slider member comprises a first surface portion, the hinged rope lock member comprises a second surface portion, and the first surface portion and the second surface portion align.

7. The hinged sliding assembly of claim 1, wherein the hinged rope lock member further comprises a rope lock member that at least partially surrounds the rope of the pool cover coupled to the hinged rope lock member.

8. A pool cover assembly comprising:

a track;

a pool cover comprising a rope extending along at least one edge of the pool cover; and a hinged sliding assembly moveable along the track, the hinged sliding assembly comprising:

a slider member comprising a rod member and defining an opening, wherein the slider member is coupled to the pool cover; and a hinged rope lock member at least partially surrounding the rod member proximate a first end of the hinged rope lock member, coupled to the rope proximate a second end of the hinged rope lock member, and positioned at least partially within the opening.

9. The pool cover assembly of claim 8, wherein the slider member and the hinged rope lock member are arranged at least partially within a channel of the track.

10. The pool cover assembly of claim 8, wherein the rod member extends at least partially across the opening.

11. The pool cover assembly of claim 8, wherein the rod member extends parallel to a longitudinal length of the slider member.

12. The pool cover assembly of claim 8, wherein the hinged rope lock member at least partially surrounds the rod member along an entire longitudinal length of the hinged rope lock member.

13. The pool cover assembly of claim 8, wherein the hinged rope lock member is rotatable about the rod member.

14. The pool cover assembly of claim 8, wherein the slider member comprises a first surface portion, the hinged rope lock member comprises a second surface portion, and the first surface portion and the second surface portion align.

15. The pool cover assembly of claim 8, wherein the hinged rope lock member further comprises a rope lock member that at least partially surrounds the rope of the pool cover coupled to the hinged rope lock member.

16. A method of extending or retracting a pool cover, the method comprising:

applying a force to a rope, wherein the rope extends along at least one edge of the pool cover and is coupled to a hinged rope lock member of a pool cover assembly, wherein the pool cover assembly comprises:

a track;

the pool cover comprising the rope extending along at least one edge of the pool cover; and a hinged sliding assembly moveable along the track, the hinged sliding assembly comprising:

a slider member comprising a rod member and defining an opening, wherein the slider member is coupled to the pool cover; and the hinged rope lock member at least partially surrounding the rod member proximate a first end of the hinged rope lock member, coupled to the rope proximate a second end of the hinged rope lock member, and positioned at least partially within the opening;

first sliding, in response to the applying a force step, the hinged rope lock member along the rod member in a first direction; and second sliding, in response to the first sliding step, the slider member along the track to extend the pool cover.

17. The method of claim 16, further comprising:

applying an opposite force to the rope;

third sliding, in response to the applying the opposite force step, the hinged rope lock member along the rod member in a second direction; and fourth sliding, in response to the third sliding step, the slider member along the track to retract the pool cover.

18. The method of claim 17, wherein the hinged rope lock member further comprises a rope lock member at the second end of the hinged rope lock member that at least partially surrounds the rope.

19. The method of claim 16, wherein the hinged rope lock member at least partially surrounds the rod member along an entire longitudinal length of the hinged rope lock member.

20. The method of claim 16, wherein the hinged rope lock member is rotatable about the rod member.

* * * * *